US009302527B2

(12) United States Patent
Lowery

(10) Patent No.: US 9,302,527 B2
(45) Date of Patent: Apr. 5, 2016

(54) TWO-SIDED STRING-BOUND BOOK

(71) Applicant: Ashley Anna Lowery, Harbor City, CA (US)

(72) Inventor: Ashley Anna Lowery, Harbor City, CA (US)

( * ) Notice: Subject to any disclaimer, the term of this patent is extended or adjusted under 35 U.S.C. 154(b) by 0 days.

(21) Appl. No.: 14/603,054

(22) Filed: Jan. 22, 2015

(65) Prior Publication Data

US 2015/0130176 A1 May 14, 2015

(51) Int. Cl.
*B42D 1/06* (2006.01)
*B42F 13/04* (2006.01)
*B42F 13/06* (2006.01)

(52) U.S. Cl.
CPC . *B42D 1/06* (2013.01); *B42F 13/04* (2013.01); *B42F 13/06* (2013.01)

(58) Field of Classification Search
CPC ..... B42F 13/04; B42F 13/06; B42D 1/06
USPC ..... 281/5, 21.1, 27; 402/8
See application file for complete search history.

(56) References Cited

U.S. PATENT DOCUMENTS 3,738,686 A * 6/1973 Morse ..... B42D 1/00 281/5
4,598,934 A * 7/1986 Cashel ..... B42D 1/06 281/5
4,932,679 A * 6/1990 Mayer ..... B42D 1/00 281/5
5,403,237 A * 4/1995 Gurevich ..... B42D 1/06 281/2
6,454,307 B1 * 9/2002 Polick ..... B42D 1/00 281/21.1
6,702,331 B2 3/2004 Derraugh et al.
2009/0160172 A1 * 6/2009 Dudley ..... B42D 1/001 281/21.1
2012/0200074 A1 8/2012 Kuch

FOREIGN PATENT DOCUMENTS

DE 102007023612 A1 * 12/2008 ..... B42D 1/06

* cited by examiner

*Primary Examiner* — Kyle Grabowski
(74) *Attorney, Agent, or Firm* — The Law Office of Scot S. Fagerland

(57) ABSTRACT

A reversible notebook combines the features of accordion-folded pages and unique string binding. The accordion-folded pages allow for the continuous presentation of text or images with no area lost to bound margins. This is ideal for small presentations such as a portfolio of business cards. As another advantage, the notebook has uniform thickness rather than being thicker at one spine than the other. The string binding allows the notebook to be opened at either spine while the other spine remains secured closed. In conjunction with the accordion fold, this allows for presentation of two different sequences of content. The notebook may be large enough to use as a journal or album. For larger implementations, magnets or locks may be used to further secure one or both spines.

8 Claims, 6 Drawing Sheets

TWO-SIDED STRING-BOUND BOOK

1. FIELD OF THE INVENTION

This invention is in the field of books, strips, and leaves.

2. BACKGROUND OF THE INVENTION

Business cards are a traditional way to make introductions. The obvious limitation of a business card is its size. Only a small amount of information can be printed on each side of a card, so it usually refers to outside contact information. For an artist or professional with a portfolio, or a business with many options, it is desirable to have a multi-faceted presentation.

This invention provides a small notebook, the best contemplated application of which is for a portfolio of business cards.

When several business cards are simply bound together into a miniaturized notebook, numerous problems occur. First, there is the "margin problem." The process of binding pages together obfuscates their inner margins. When the sheets are as small as business cards, every millimeter matters. Second is the "non-uniformity problem." A bound notebook does not lie perfectly flat. It is typically thicker at one end than the other. Depending on how it is bound, a book with small pages may have trouble staying open or closed. If a business card notebook had non-uniform thickness, it would be difficult to put in a pocket or wallet. There is also a "non-continuity" problem, related to the margin problem. It is impossible to present a smoothly continuous image on two adjacent pages when the margins are pinched together out of sight.

This invention allows for a business card portfolio with none of the described limitations. This is accomplished by means of a unique folding and binding method. The notebook comprises one continuous sheet folded in concertina fashion (also known as an "accordion fold"). Each end of the sheet is secured to a cover. The covers are bound together with thin string in a particular configuration. This unique binding allows the notebook to be opened at either spine, while the opposite spine remains secured. The concertina fold allows for full utilization of each page, with no lost margins or discontinuity between pages. Because the binding is thin and symmetric, the notebook lies flat with uniform thickness and may be easily pocketed. As a consequence of the binding, the notebook also has the novelty feature of allowing "two books in one." The book may be opened along one spine to show one portfolio, and then turned around and opened along the other spine to reveal another portfolio.

3. DESCRIPTION OF RELATED TECHNOLOGY

A reversible book was disclosed in U.S. Pat. No. 4,932,679 by Mayer, Becker, and Witt. The Becker-Mayer product was in particular a children's book. This book featured one single sheet folded in concertina fashion. Each spine was bound with Velcro. The book could be opened at either spine, or in fact both spines could be unbound simultaneously. Each side of the single sheet presented a different story.

Another reversible children's book was disclosed by Derraugh and Morris in U.S. Pat. No. 6,702,331. This product was envisioned as a children's book for the bathtub. It consisted of several consecutive foam panels taped together on alternating faces. It did not have any covers or spines; its two configurations were "stacked" or "stretched out." The Derraugh-Morris patent was claimed very narrowly. It required a "foam-based" construction so it could be used in the bathtub.

U.S. Pat. No. 6,454,307, "Readable Device with a Movable Binding Which Alternately Allows Access to One or Two Sets of Pages," was invented by Peter Polick and assigned to Innovative USA. This concertina-folded book had one binding that slid from one end of the book to the other. When the binding was on the left side of the book, the left spine was bound and the right spine could be opened. Then the binding could be repositioned to the right spine so that the left spine could be opened. The Innovative USA patent was again defined narrowly according to the mechanics of its slidable binding.

A "Magnetic spine binding" was disclosed by Michael Kuch and Joseph Riedel in US patent application 2012/0200074. Kuch and Riedel described an accordion-folded sheet with magnets on one spine.

4. SUMMARY OF THE INVENTION

My invention combines the accordion or concertina fold configuration with a novel and unique binding method. The binding can be accomplished with thin string, so it is ideal for a small notebook at the scale of business cards. The string allows either spine of the notebook to be opened while the other spine is securely closed by the string. No tying or untying is required, nor is any binding agent such as clasps, Velcro, or magnets.

The binding is achieved with string in a novel, unique configuration. Some pieces of string are strung freely over the interior of the first cover and secured to the exterior of the second cover. Other pieces of string are strung freely over the interior of the second cover and secured to the exterior of the first cover. This allows either spine to be opened while the other spine is secured by the string.

5. BRIEF DESCRIPTION OF THE DRAWINGS

6. DETAILED DESCRIPTION OF THE PREFERRED EMBODIMENTS

Figure 1:
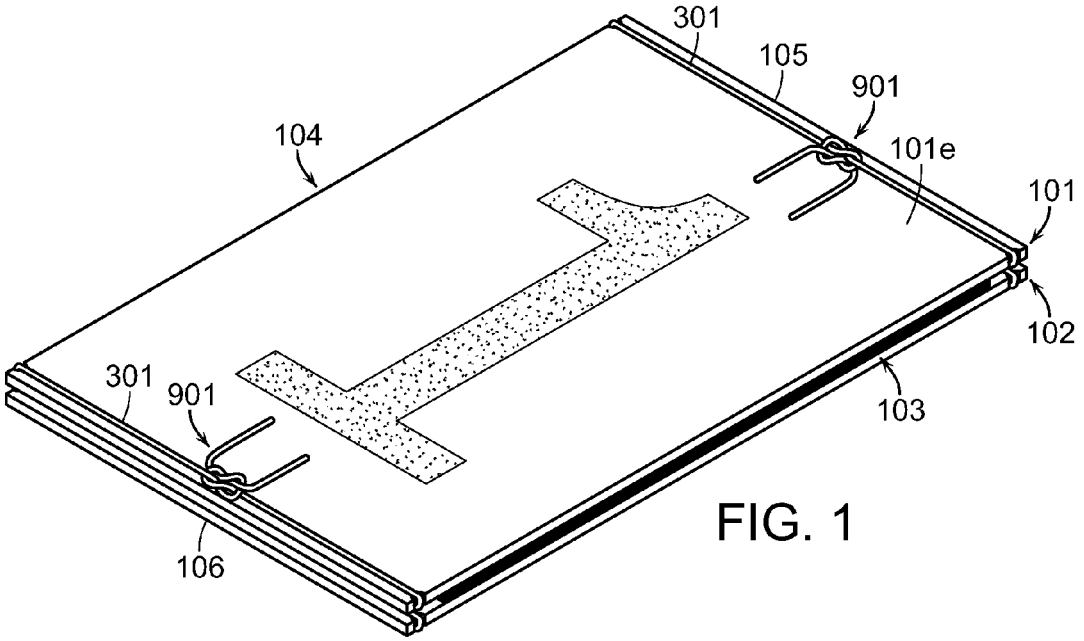
FIG. 1 is a perspective view of the notebook in closed position, showing the exterior surface of the first cover.
Figure 2:
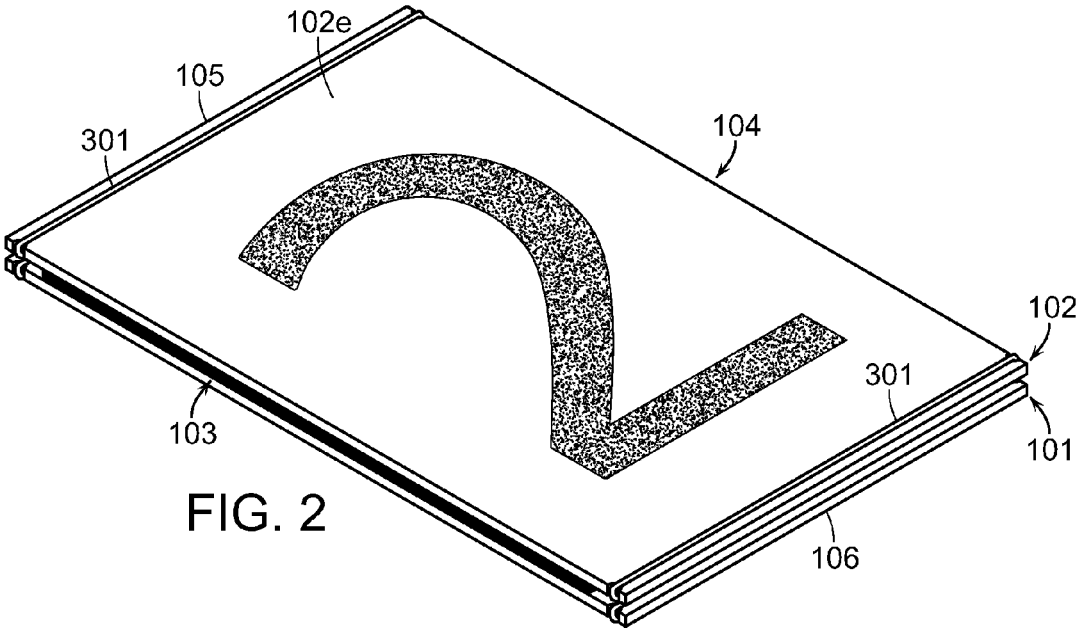
FIG. 2 is a perspective view of the notebook in closed position, showing the exterior surface of the second cover.

The notebook is shown in closed position in FIGS. 1 and 2. The notebook has a first cover (101) and a second cover (102). In closed position, the exterior surface of the first cover (101*e*) is visible on one face of the notebook, and the exterior surface of the second cover (102*e*) is visible on the opposite face. The notebook has a front spine (103) and a rear spine (104), a top edge (105), and a bottom edge (106).

Figure 3:
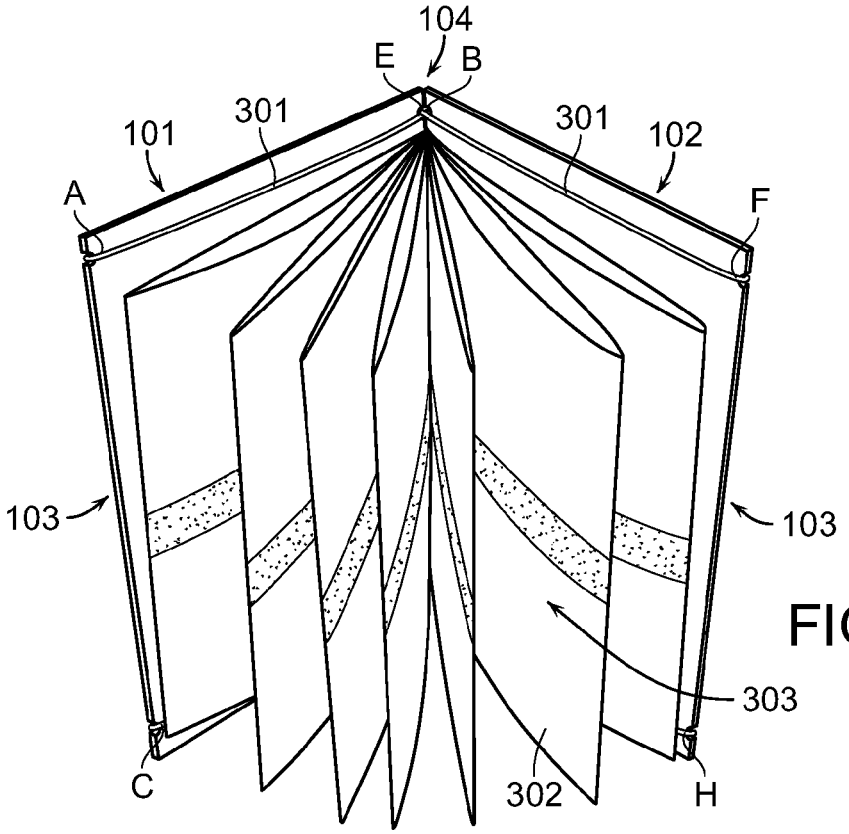
FIG. 3 is a front view of the notebook in first open position, revealing first contents.

FIG. 3 is a view of the notebook from the "front," defined as the vantage point from which the first cover (101) appears on the viewer's left. String binding (301) is visible above the pages (302). This view shows the notebook in the first open position, wherein the front spine (103) is open and the rear spine (104) is secured by the string binding. In particular, the top edge of the rear spine (104) is secured by points B and E on the string binding. The bottom edge of the rear spine is secured by points D and G on the string binding, not shown in FIG. 3.

In first open position, the pages (302) reveal first content (303). FIG. 3 demonstrates how the pages are folded accordion style, so that the second content (501) is not visible in this position.

Figure 4:
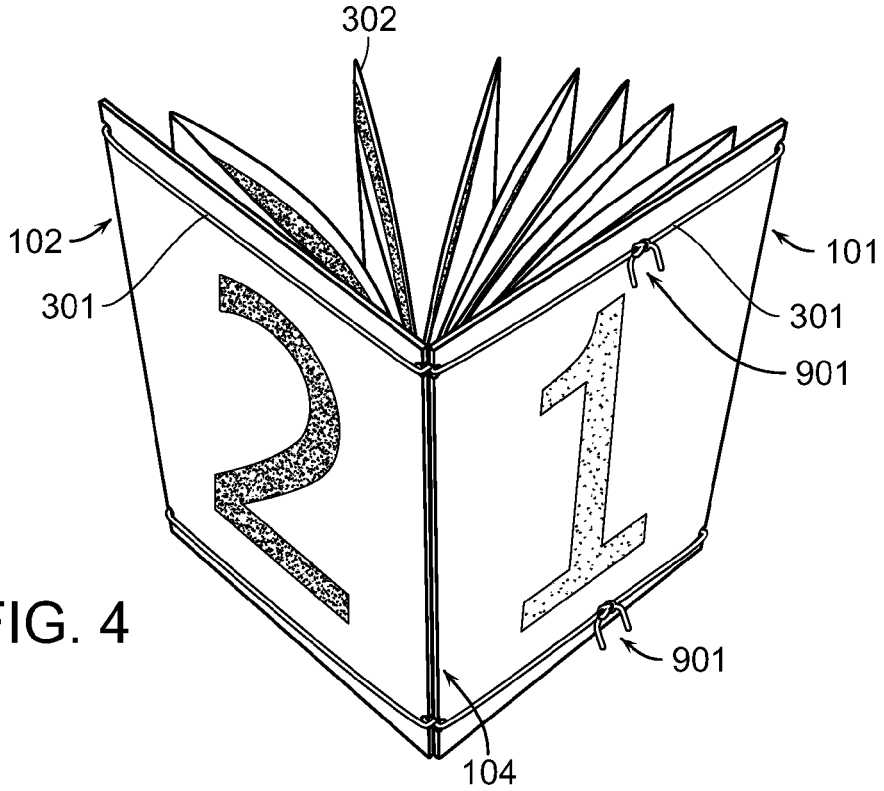
FIG. 4 is a rear view of the notebook in first open position.

FIG. 4 shows the first open position from the "rear," defined as the vantage point from which the first cover (101) appears on the viewer's right. Because this is the first open position, the rear spine (104) is secured closed.

Figure 5:
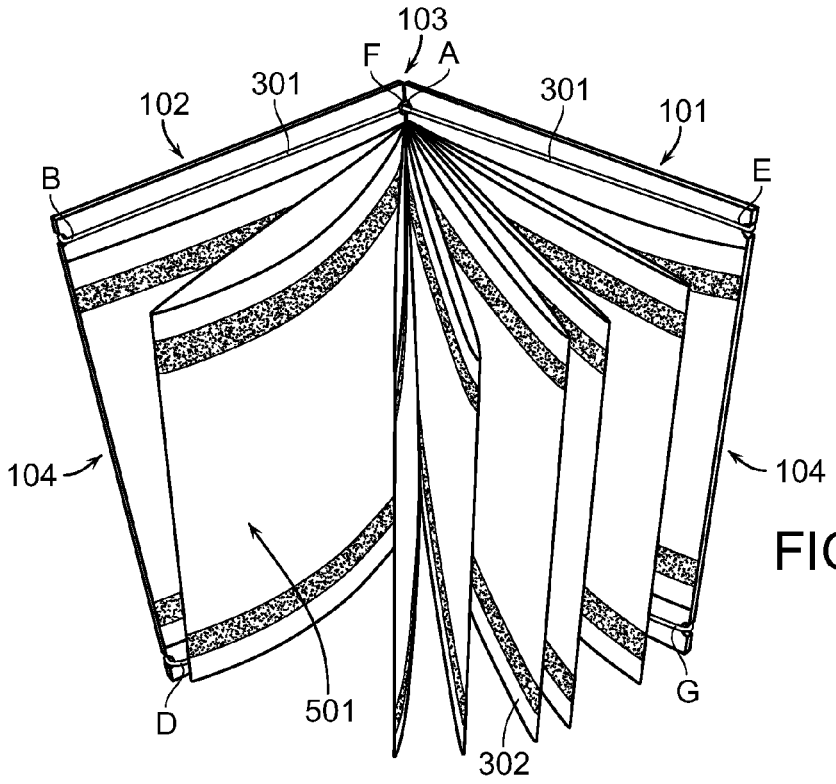
FIG. 5 is a rear view of the notebook in second open position, revealing second contents.

The nature of the string binding allows the rear spine (104) to be opened as well. In FIG. 5, the notebook is still viewed from the rear, but the rear spine has been opened. This is the notebook's second open position. The front spine (103) is now secured closed. In particular, the top edge of the front spine (103) is secured closed by points A and F on the string binding. The bottom edge of the front spine (103) is secured closed by points C and H on the string binding, not visible in FIG. 5. In second open position, the pages (302) reveal second content (501). Due to the accordion fold of the pages, the first content (303) is not visible in the second open position.

Figure 6:
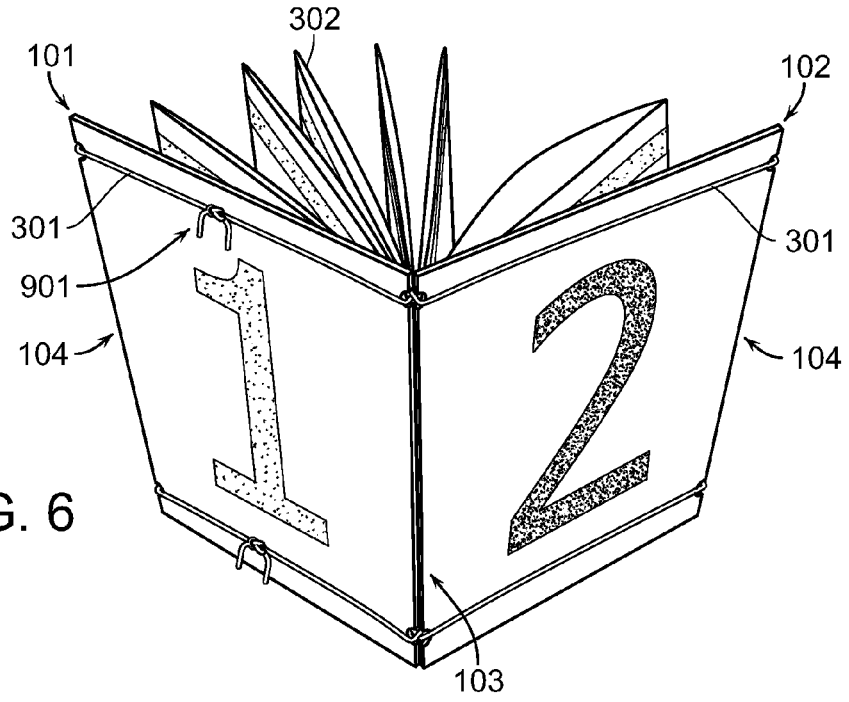
FIG. 6 is a front view of the notebook in second open position.

The notebook is viewed in second open position from the front in FIG. 6.

Figure 7:
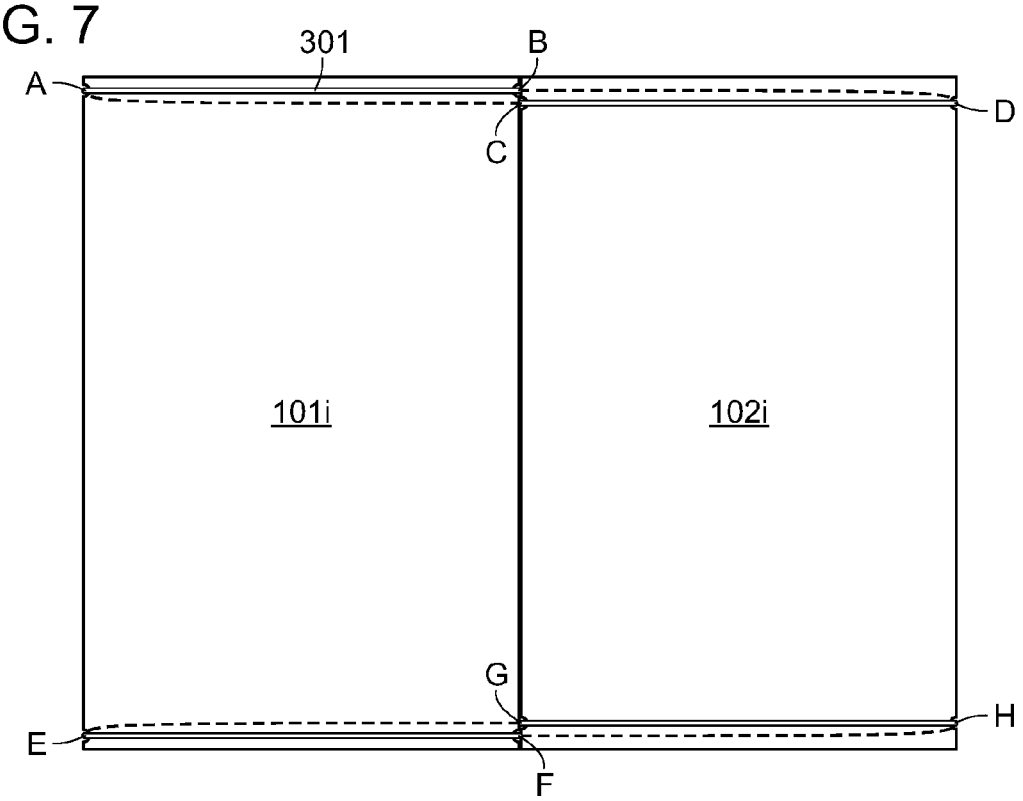
FIG. 7 shows a detail of the string configuration in first open position. This view looks at the interiors of the covers.
Figure 8:
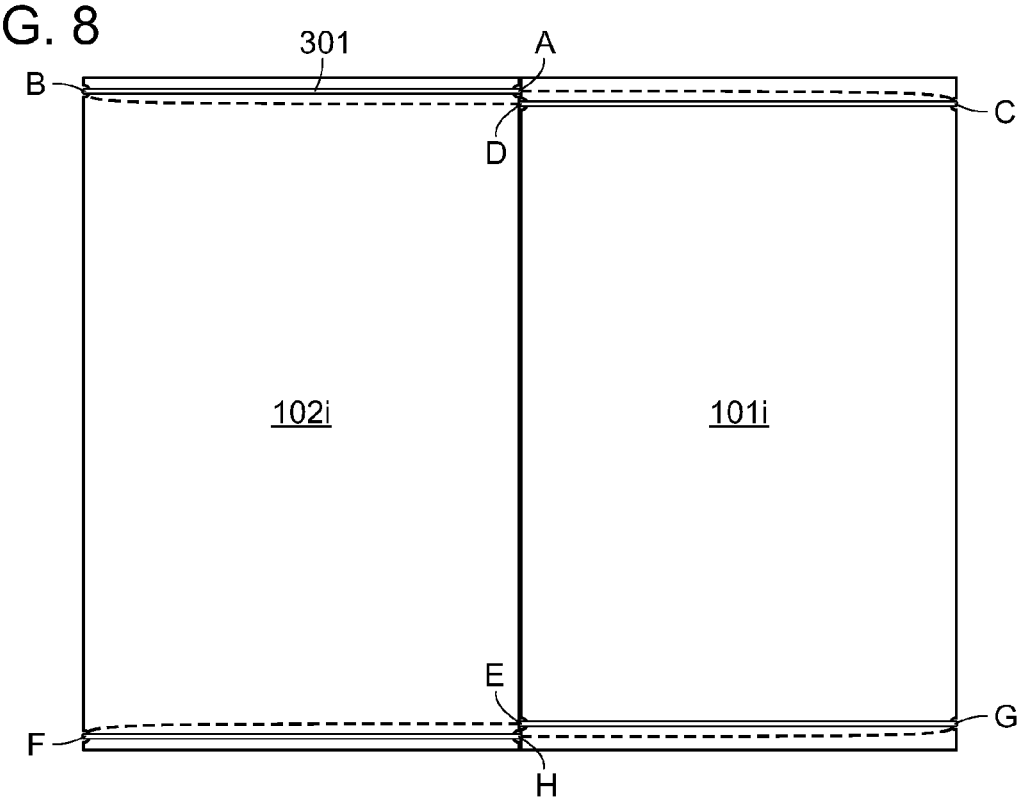
FIG. 8 shows a detail of the string configuration in second open position. This view looks at the interiors of the covers.

FIGS. 7 and 8 demonstrate the workings of the string binding (301). For clarity, the pages (302) are not shown in these figures. The string binding consists of two or more separate pieces of string, each of which is strung freely over the interior of one cover and attached to the exterior of the other cover. The embodiment shown in the figures shows four separate pieces of string, AB, CD, EF, and GH. In the embodiment shown, strings AB and CD are joined together into one continuous string loop, and strings EF and GH are joined together into another continuous string loop. In an alternative embodiment, strings AB, CD, EF, and GH would be four separate pieces of string.

FIG. 7 shows the notebook in first open position, viewing the interior of the covers. Strings AB and EF are strung freely over the interior surface of the first cover (101*i*) and secured to the exterior surface of the second cover (102*e*) which is "hidden" in this figure. Strings CD and GH are strung freely over the interior surface of the second cover (102*i*) and secured to the exterior surface of the first cover (101*e*) which is "hidden" in this figure.

By flipping the first cover (101) closed over the second cover (102), and then opening the rear spine (103), the book flips into second open position as shown in FIG. 8. In this position, strings AB and EF are strung freely over the interior of the second cover (102*i*) and secured to the exterior surface of the first cover (101*e*), hidden in this figure. Strings CD and GH are strung freely over the interior surface of the first cover (101*i*) and secured to the exterior surface of the second cover (102*e*), hidden in this figure.

Figure 9:
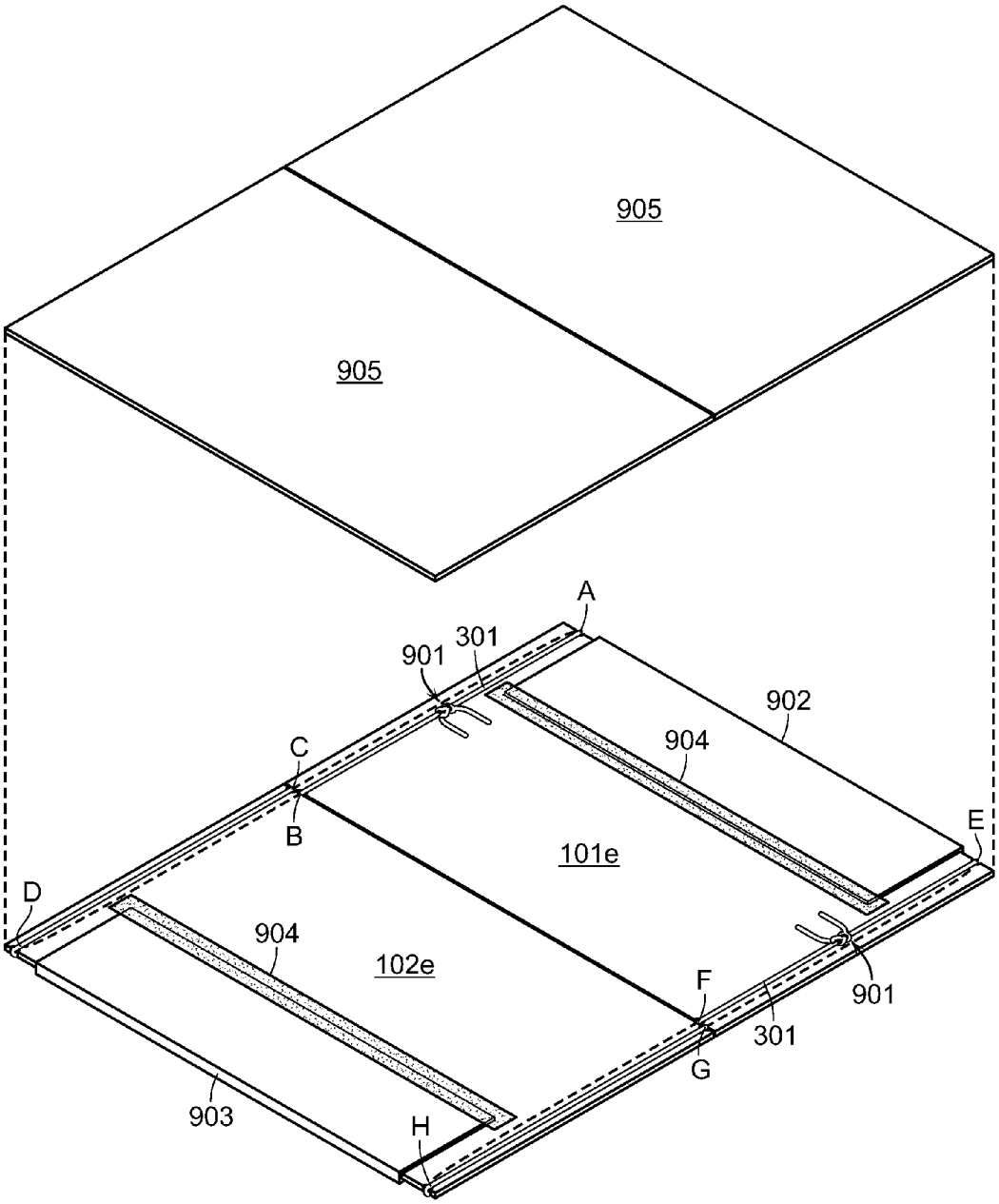
FIG. 9 shows the exterior covers and the cover protectors.

FIG. 9 is a rear view of the notebook in first open position. This view shows the exterior of the first cover (101*e*) and the exterior of the second cover (102*e*). The string assembly (301) is seen secured to exterior faces (101*e*) and (102*e*) with string adhesive means (901). The first page (902) is shown here secured to the exterior of the first cover (101*e*) with page adhesive means (904). The last page (903) is secured to the exterior of the second cover (102*e*) with page adhesive means. In an alternative embodiment, the first page (902) is secured to interior cover (101*i*), and the last page (903) is secured to interior cover (102*i*). As the string assembly (301), the first page (902), and the last page (903) can make the exterior covers (101*e*) and (102*e*) unsightly, it is desirable to conceal the covers with cover protectors (905). The cover protectors may be merely ornamental. They may also be made of more resilient material than the covers themselves, thereby adding to the durability or weatherability of the entire notebook.

The string assembly (301) is secured to the upper and lower margins of the covers. The pages (302) are situated entirely between the upper and lower strings in the string binding (301), so the pages do not interfere with the strings' freedom to open and close. This arrangement is seen best in FIGS. 3 and 5.

Figure 10:
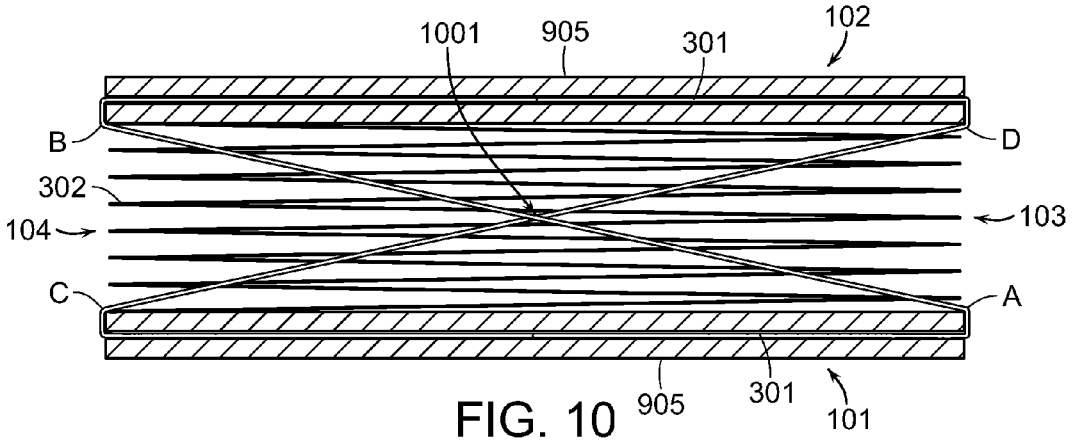
FIG. 10 is a top-plan view of the notebook with the covers partially pulled apart. This view clearly shows the nature of the accordion fold and the strings between the two covers.

FIG. 10 is a top plan view of the notebook in closed position. The first cover (101) and second cover (102) are artificially pulled apart somewhat in this view to show the accordion fold configuration of the pages (302) and the "X" configuration of the string binding (301). The pivot point (1001) of the string assembly is where two strings cross each other. As the front spine (103) is opened, points A and D are pulled apart while the pivot point (1001) is drawn closer to pots B and C, securing the rear spine (104). As the rear spine (104) is opened, points B and C are pulled apart while the pivot point (1001) is drawn closer to points A and D, securing the front spine (103).

Figure 11:
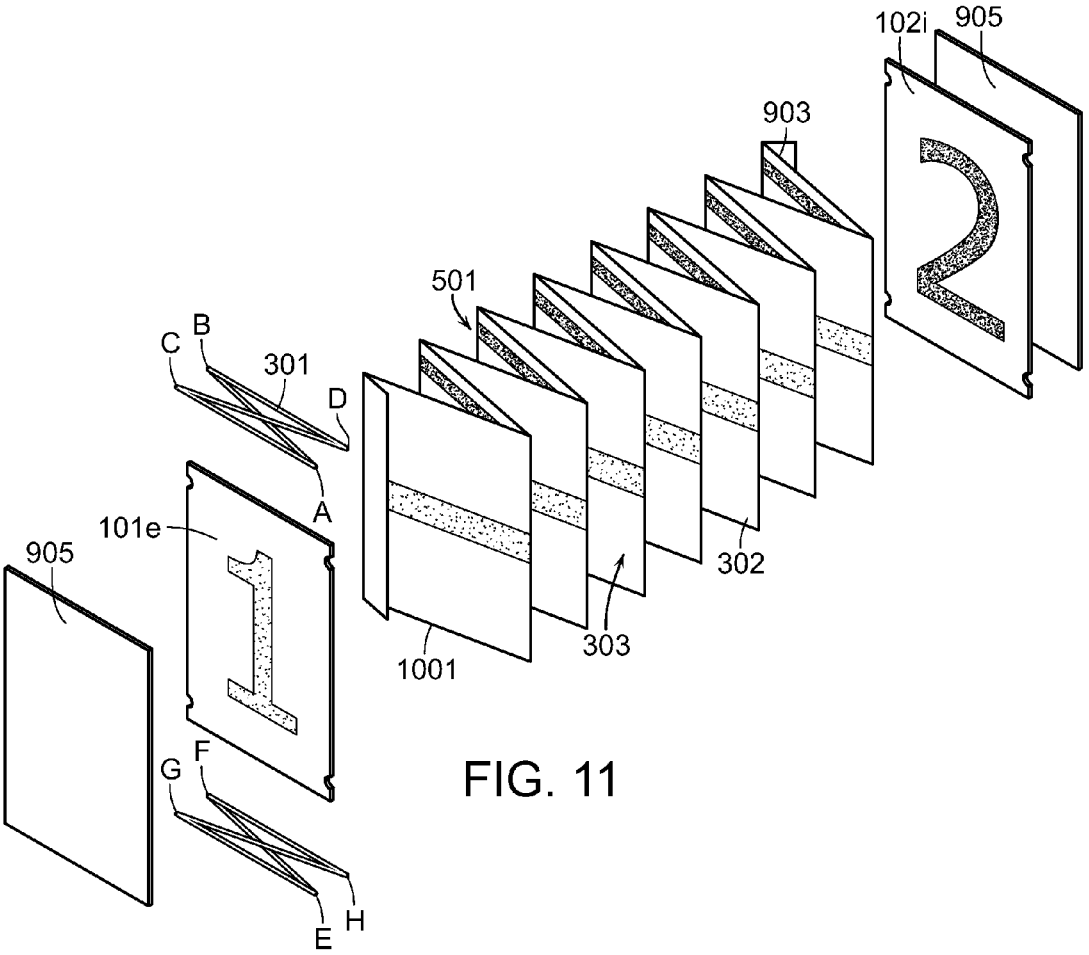
FIG. 11 is an exploded view of the notebook.

FIG. 11 is an exploded view showing all relevant parts of the notebook. In this view, the exterior of the first cover (101*e*) and the interior of the second cover (102*i*) are visible. Points A, C, E, and G of the string binding are secured to the exterior of the first cover (101*e*). Points B, D, F, and H of the string binding are secured to the exterior of the second cover (102*e*). Cover protectors (905) may be secured to the exterior covers (101*e*) and (102*e*).

In FIG. 11, the pages (302) are revealed to be one single sheet of paper in accordion fold configuration. First content (303) is visible on one side of the sheet, and second content (501) is visible on the other side of the sheet. The first page (902) may be secured to the first cover either on the interior (101*i*) or wrapped around to the exterior (101*e*). The last page (903) may be secured to the second cover either on the interior (102*i*) or wrapped around to the exterior (102*e*).

In its best form, the reversible notebook is approximately the size of a business card. However, the concept can readily be extended to larger notebooks, journals, scrapbooks, albums, etc. In the event of larger books, further securing means can be used along one or both spines. Examples of securing means can include locks or magnetic clasps. With a lock on the rear spine, the notebook could be used as a novelty diary. First contents would be freely displayed by opening the front spine. A key would be required to open the rear spine to view second contents.

I claim:

1. A reversible notebook, comprising:

a first cover;

a second cover parallel to the first cover;

a single sheet of paper between the first cover and the second cover, folded accordion-style into at least four pages, with the first page secured to the interior surface of the first cover by adhesive binding means and the last page secured to the interior surface of the second cover by adhesive binding means;

first contents displayed on one surface of the sheet of paper;

second contents displayed on the sheet of paper, on the surface opposite the first contents;

string binding, including at least one piece of suing strung freely over the interior surface of the first cover and secured to the exterior surface of the second cover, and at least one piece of string strung freely over the interior surface of the second cover and secured to the exterior surface of the first cover;

said string binding allowing the reversible notebook to be opened at the front spine while the rear spine is secured, or opened at the rear spine while the front spine is secured.

2. The reversible notebook as disclosed in claim 1, further comprising cover protectors over the strings secured to the exterior of each cover.

3. The reversible notebook as disclosed in claim 2, wherein each cover and page have dimensions of approximately the size of a business card.

4. The reversible notebook as disclosed in claim 2, further comprising magnetic securing means on one or both spines.

5. The reversible notebook as disclosed in claim 2, further comprising a lock on one or both spines.

6. The reversible notebook as disclosed in claim 1, wherein each cover and page have dimensions of approximately the size of a business card.

7. The reversible notebook as disclosed in claim 1, further comprising magnetic securing means on one or both spines.

8. The reversible notebook as disclosed in claim 1, further comprising a lock on one or both spines.

* * * * *